United States Patent [19]

Buescher et al.

[11] 4,009,409

[45] Feb. 22, 1977

[54] FAST WARMUP CATHODE AND METHOD OF MAKING SAME

[75] Inventors: William E. Buescher, Seneca Falls; Donald R. Kerstetter, Emporium, both of Pa.

[73] Assignee: GTE Sylvania Incorporated, Stamford, Conn.

[22] Filed: Sept. 2, 1975

[21] Appl. No.: 609,447

[52] U.S. Cl. ..... 313/337; 313/37; 313/41; 313/45; 313/340; 427/77

[51] Int. Cl.[2] ..... H01J 1/20; H01J 19/14

[58] Field of Search ..... 313/37, 38, 41, 45, 313/337, 340, 341, 346; 427/77

[56] References Cited

UNITED STATES PATENTS

| | | | |
|---|---|---|---|
| 1,555,677 | 9/1925 | Leblanc | 313/41 |
| 2,057,124 | 10/1936 | Van Gessel et al. | 313/41 X |
| 2,236,289 | 3/1941 | Hull | 313/37 |
| 3,262,814 | 7/1966 | Provisor | 427/77 |
| 3,326,648 | 6/1967 | Provisor | 427/77 |
| 3,662,211 | 5/1972 | Millis | 313/340 |
| 3,823,337 | 7/1974 | Van Stratum et al. | 313/337 |

*Primary Examiner*—Saxfield Chatmon, Jr.
*Attorney, Agent, or Firm*—Norman J. O'Malley; William H. McNeill; Robert T. Orner

[57] ABSTRACT

A fast warmup cathode comprises a substrate of nickel or cathode nickel alloy having an outer and an inner surface. At least an area of the outer surface is formed to receive an electron emissive material. The inner surface is provided with a high heat radiating material. The high heat radiating material comprises vacuum deposited aluminum or magnesium which has been fired at a temperature above the melting point of the material to provide a surface which is darker than the unaltered surface of the substrate. aluminum or magnesium which has been

6 Claims, 3 Drawing Figures

FAST WARMUP CATHODE AND METHOD OF MAKING SAME

BACKGROUND OF THE INVENTION

This invention relates to electron discharge device cathodes and particularly to fast warmup cathodes. While not limited thereto, it has particular application in the multiple gun structure of color cathode ray tubes employed in color television receivers.

Conventional cathode ray tubes of the color variety are provided with multiple electron guns each of which contains an electron emitting cathode. The cathodes are usually indirectly heated; i.e., they comprise a more or less tubular cathode assembly with a closed end having an insulated heater therein to provide the heat necessary to cause an emissive material to emit electrons.

The cathodes normally employed in color cathode ray tubes conventionally have a warmup time of 12 to 15 seconds; i.e., it requires that long a time for sufficient electrons to be present from the cathode to be drawn to the anode and establish a raster on the screen of the tube. These warmup times have been considered to be detrimental to the viewing public in that it requires a long wait from turn-on to an acceptable or viewable picture on the tube. In the past, this detrimental condition has been obviated by the provision of an "instant on" feature provided by some television receiver manufacturers. With this feature a raster or viewable picture is obtained on the picture tube almost instantaneously with the turn-on of the set. However, in the past this feature has not been accomplished by a fast warmup cathode but rather by a bleeder current which constantly maintains the cathode heater at a near normal operating temperature. Thus, in effect, the cathode ray tube is never completely turned off. When the television receiver is a complete tube version containing many receiving tubes or a hybrid version including some tubes and some solid state devices, the bleeder current of the "instant on" feature is applied also to the heaters of the other receiving tubes within the set. This condition has been alleged to provide a dangerous fire hazard in some receivers. It is also quite wasteful of electricity since, as mentioned above, the receiver is never completely turned off and the set is constantly drawing electrical power.

Fast warmup cathodes have been proposed as the solution to this problem; however, many of the proposed types have been either extremely difficult to build or have been very expensive or have required considerable design changes in the conventional electron gun structures.

One construction that has obviated some of these problems is shown in U.S. Pat. No. 3,881,124. An improvement to the cathode shown in the 3,881,124 patent is described in U.S. Pat. application Ser. No. 494,640, filed Aug. 5, 1974, now U.S. Pat. No. 3,919,751 as a division of Ser. No. 440,685, filed Feb. 8, 1974 now abandoned. The above recited patent and applications are assigned to the assignee of the present invention. In Ser. No. 494,640 it is taught that the warmup time can be decreased by employing a black, high heat radiating material on the inside of the cathode. A suggested material is an alloy comprised essentially of about 20% chromium with the remainder being nickel. To transform this material to a black coating it is fired in wet dissociated ammonia for about 10 minutes at at least 900° C and preferably at 1200 to 1300° C. Herein lies a problem; namely, while individual cathodes can be manufactured by this technique, the high firing temperatures can cause diffusion bonding between cathodes when mass production is employed. Accordingly, it would be an advance in the art if the above problems could be avoided.

OBJECTS AND SUMMARY OF THE INVENTION

It is, therefore, an object of the invention to obviate the disadvantages of the prior art.

It is another object of the invention to enhance fast warmup cathodes.

Yet another object of the invention in an enhanced method of making such cathodes.

These objects are accomplished in one aspect of the invention by the provision of an indirectly heated cathode for an electron discharge device. The cathode comprises a formed substrate of a material selected from the group of nickel and cathode nickel alloys and has an outer surface and an inner surface. At least an area of the outer surface is formed to receive an electron emissive material. The inner surface is coated with a vacuum deposited vaporized metal which has been fired at a temperature above the melting point of the vaporized metal until a dark surface has been achieved.

The cathode is fabricated by first vacuum depositing a metal selected from the group of aluminum and magnesium upon one side of a cathode substrate. The substrate is then formed into a cathode body with the coated surface on the interior thereof. Thereafter, the cathode body is fired under conditions which cause said coated material to darken. Alternatively, the coated material can be transformed before the substrate is formed into a cathode body.

Cathodes produced by this method are easy to manufacture and mass produce. The firing temperature and time of firing are well below those used heretofore, and thus diffusion bonding of the cathodes together is no longer a problem.

DESCRIPTION OF THE PREFERRED EMBODIMENT

For a better understanding of the present invention together with other and further objects, advantages, and capabilities thereof, reference is made to the following disclosure and appended claims in connection with the above-described drawings.

Figure 1:
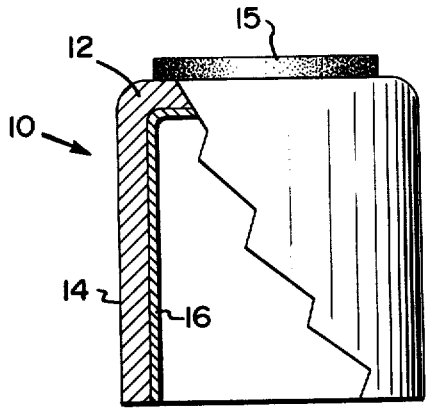
FIG. 1 is a partially sectioned elevational view of one type of cathode body which employs the invention.

Referring now to the drawings with greater particularity there is shown in FIG. 1 a cathode body 10 formed from a substrate of nickel or a cathode nickel alloy. Cathode nickel alloys are known materials and an extensive, albeit partial, listing of such materials can be found in "Materials and Techniques for Electron Tubes" by Walter H. Kohl, copyright 1960, and published by the Rheinhold Publishing Corporation, New York, New York.

Figure 3:
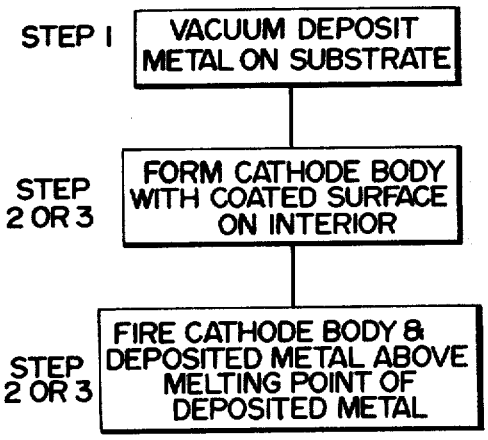
FIG. 3 is a flow diagram of the method of the invention.

Cathode body 10 is substantially cup-shaped with a closed end 12 and a peripheral sidewall 14. Closed end 12 is formed to receive an electron emitting material 15. The interior walls of cathode body 10 are covered with a thin layer of a vacuum deposited, vaporized metal 16 which has a darker color than the outside surface of body 10. The vaporized material is selected from the group consisting of aluminum and magnesium and has been fired at a temperature above the melting point thereof to transform it and provide the darker color. Firing can take place in an atmosphere of dry hydrogen (dew point <0° C); an inert atmosphere; or a vacuum having a pressure of <0.5 Torr. As indicated by FIG. 3, the firing and transformation of vaporized metal 16 can be performed either before or after the substrate is formed into a cathode body. The cathode body 10 is of the type usually employed in conjunction with a cathode stack for assembly into an electron gun for a cathode ray tube. Such an exemplary construction is shown in the above-cited U.S. Pat. No. 3,881,124.

Figure 2:
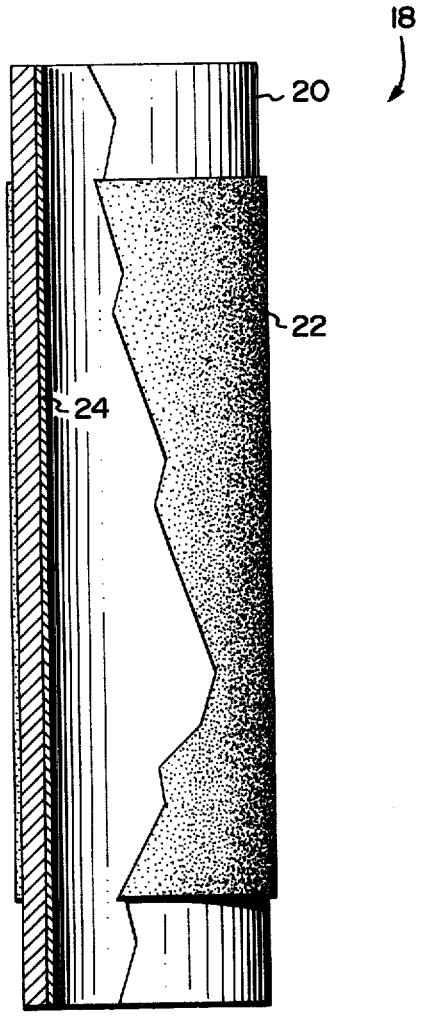
FIG. 2 is a partially sectioned elevational view of a second type of cathode body employing the invention.

An alternate form of cathode body 18 is shown in FIG. 2. Herein, the body 18 is substantially tubular having open ends and a circumferential side 20. Such cathodes are usually employed in receiving tubes. At least a portion of side 20 is provided with an electron emissive material 22. The interior surface of side 20 is provided with the thin layer of a vacuum deposited, vaporized metal 24 as was cathode body 10.

The exact chemical nature of the dark layer, after firing, is not known. While essentially pure aluminum or magnesium is deposited, the composition, after firing is suspected of being a complex oxide of nickel-aluminum or nickel-magnesium, depending upon the material used.

Deposition of the material occurs with known techniques. That is, the substrate is presented in a vacuum ($10^{-5}$ Torr in the case of aluminum and $10^{-6}$ Torr in the case of magnesium) and a quantity of the material to be deposited is vaporized, as by bombardment with an electron beam. Preferably, the substrate is also heated. The deposited material should have a thickness of about $30\times10^{-6}$ inches (0.85 microns) or less. As applied, the appearance of the deposited material is quite silvery.

The now coated substrate can be formed into an appropriate cathode body and fired or it can be fired first and then formed into a cathode body, under any of the various conditions noted above. The firing temperature must be above the melting point of the deposited material; i.e., <660° C for aluminum or <650° C for magnesium. The time is not critical since the transformation is virtually instantaneous upon reaching the appropriate temperature.

The color of the transformed material approximates 5 to 6 on the Kodak Gray Scale for aluminum and 1 to 2 for magnesium. The darker color of the magnesium is offset to some extent by the need for the greater vacuum to deposit the same.

The low firing temperature for transformation, together with the dry or inert atmosphere which can be employed, as well as firing in vacuo provide unique results. For example, utilizing these techniques, a coated substrate can be formed into a cathode body, be assembled to a stack (if necessary), inserted into a tube and be transformed during normal tube sealing and exhaust procedures, since the necessary transformation temperature and degree of vacuum (<0.5 Torr) are present. This eliminates a separate process step.

Even if transformation is achieved before assembly into a tube the firing temperatures are well below the diffusion bonding temperatures used heretofore, and thus batch processing of cathode bodies is feasible.

While there have been shown and described what are at present considered to be the preferred embodiments of the invention, it will be obvious to those skilled in the art that various changes and modifications can be made therein without departing from the scope of the invention as defined by the appended claims.

What is claimed is:

1. An indirectly heated cathode for an electron discharge device comprising: a formed substrate of a material selected from the group of nickel and cathode nickel alloys, said formed substrate having an outer surface and an inner surface, at least an area of said outer surface being formed to receive an electron emissive material; and a coating of vacuum deposited magnesium on said inner surface, said vacuum deposited magnesium having a darker color than said outer surface after firing at a temperature above the melting point of said vacuum deposited metal.

2. The cathode of claim 1 wherein said formed substrate is substantially cup-shaped.

3. The cathode of claim 1 wherein said formed substrate is substantially tubular.

4. In a method of fabricating a fast warmup cathode, the steps comprising: vacuum depositing vaporized magnesium upon one side of a cathode substrate of a material selected from the group consisting of nickel and cathode nickel alloys; forming the coated substrate into a cathode body with the coated surface on the interior thereof; and firing said coated cathode body under conditions which cause said coated material to darken.

5. The method of claim 4 wherein said coated cathode body is fired at a temperature higher than the melting point of the deposited metal.

6. In a method of fabricating a fast warmup cathode, the steps comprising: vacuum depositing vaporized magnesium upon one side of a cathode substrate of a material selected from the group of nickel and cathode nickel alloys; firing said cathode body under conditions which cause said coated material to darken; and forming said fired substrate into a cathode body.

* * * * *